US006691339B1

(12) United States Patent
Thomas

(10) Patent No.: US 6,691,339 B1
(45) Date of Patent: Feb. 17, 2004

(54) WATER-PROOF JOINT FOR TUB SURROUND

(75) Inventor: Brent Thomas, Enville, TN (US)

(73) Assignee: Aqua Glass Corporation, Adamsville, TN (US)

( * ) Notice: Subject to any disclaimer, the term of this patent is extended or adjusted under 35 U.S.C. 154(b) by 0 days.

(21) Appl. No.: 10/246,012

(22) Filed: Sep. 18, 2002

(51) Int. Cl.[7] ..... A47K 3/02

(52) U.S. Cl. ..... 4/610; 4/584; 4/583; 4/612; 4/614

(58) Field of Search ..... 4/610, 612, 614, 4/583, 584; 52/35, 584.1, 582.1, 582.2

(56) References Cited

U.S. PATENT DOCUMENTS

| | | | | | |
|---|---|---|---|---|---|
| 2,825,098 | A | | 3/1958 | Hultquist | |
| 3,028,603 | A | | 4/1962 | Rodman | |
| 3,382,635 | A | * | 5/1968 | O'Gara | 52/270 |
| 3,827,086 | A | | 8/1974 | Seymour et al. | |
| 4,281,495 | A | | 8/1981 | Lee | |
| 4,316,295 | A | * | 2/1982 | Whitney et al. | 4/612 |
| 4,384,377 | A | * | 5/1983 | Calvert et al. | 4/614 |
| 4,817,344 | A | * | 4/1989 | Wissinger | 52/35 |
| 4,825,480 | A | * | 5/1989 | Moore | 4/595 |
| 4,901,380 | A | * | 2/1990 | Smith | 4/596 |
| 5,473,843 | A | | 12/1995 | LaRoche et al. | |
| 6,425,147 | B1 | * | 7/2002 | Hanson | 4/584 |
| 6,434,764 | B2 | * | 8/2002 | Primucci | 4/584 |

* cited by examiner

*Primary Examiner*—Henry Bennett
*Assistant Examiner*—Azy Kokabi
(74) *Attorney, Agent, or Firm*—Carlson, Gaskey & Olds

(57) ABSTRACT

A molded tub and surround which is formed of a multiple of portions. Wall portions meet at a joint which is secured by wall clamps which bias a partially arcuate portion of a second wall portion against the visible surface of a first wall portion. The first wall portion sandwiched between the wall clamps and the partially arcuate portion. A multiple of tub clamps extend from a lower edge of the wall portions to fit upon a flange extending from a tub portion. The wall clamps and tub clamps assure an easily assembled and watertight molded tub and surround.

20 Claims, 2 Drawing Sheets

WATER-PROOF JOINT FOR TUB SURROUND

BACKGROUND OF THE INVENTION

The present invention relates to a waterproof joint between two wall portions for a molded plastic tub surround and more particular to a joint arrangement therefore.

Tub surrounds are positioned within a recess built around a bathtub or shower. Conventional modular tub/shower unit often include a tub portion at the bottom and two or more wall portions. The whole structure is inserted into the wall recess to form a waterproof surround. The fully enclosed waterproof structure is highly advantageous in that it prevents the escape of water into the wall cavity despite the shower spraying water onto the surrounding walls.

One problem which has always arisen with products of this type is that of forming a suitable joint between the tub surround portions. Various styles of joint have been used, each of which providing particular tradeoffs in complexity, aesthetics and sealing ability.

Accordingly, it is desirable to provide a waterproof joint between two wall portions for a molded plastic tub surround which is uncomplicated and aesthetically pleasing while assuring an effective watertight seal.

SUMMARY OF THE INVENTION

The present invention provides a joint for a molded tub and surround which is formed of a multiple of portions. A tub portion receives wall portions to form the combined tub and surround. The tub portion defines a horizontal deck area with a substantially vertical flange extending therefore. The flange extends along three sides of the tub portion behind the wall portions when in an assembled condition.

The wall portions meet at a joint which is secured by wall clamps which bias a partially arcuate portion of a second wall portion against the visible surface of a first wall portion. The first wall portion is therefore sandwiched between the wall clamps and the partially arcuate portion.

A multiple of tub clamps extend from a lower edge of the wall portions to fit upon the flange extending from the tub portion. The tub clamps space the lower edge of wall portions inward from the flange and resists pressure exerted upon the lower portion of the wall portions.

The present invention therefore provides a waterproof joint between two wall portions and tub portion of a molded plastic tub surround which is uncomplicated and aesthetically pleasing.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
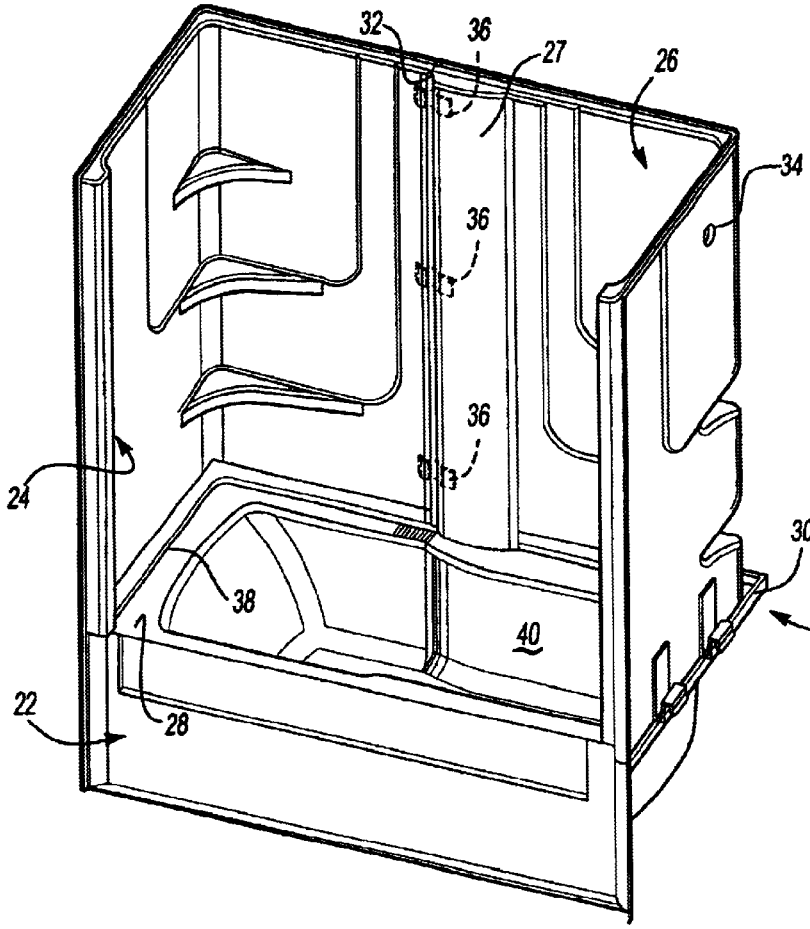
FIG. 1 is a general perspective view a molded tub and surround according to the present invention.

FIG. 1 illustrates a general perspective view of a molded tub and surround 20 which is formed of three pieces of molded plastic. A tub portion 22 receives wall portions 24 and 26 to form the combined tub and surround 20. It should be understood that any number of wall portions will benefit from the present invention. The tub portion 22 defines a horizontal deck area 28 and a substantially vertical flange 30 extending therefore. The flange 30 preferably extends along three sides of the tub portion 22 behind the wall portions 24, 26 when in an assembled condition.

A joint 32 is defined between the wall portions 24 and 26. A showerhead opening 34 is preferably located within the wall 26 such that water will move in the direction of right to left in FIG. 1. That is, wall portion 26 is considered the "wet" wall as it is closer to showerhead opening 34. The wall portion 26 includes a partially arcuate portion 27 which engages wall portion 24 to define joint 32. A plurality of wall clamps 36 (also illustrated independently in FIG. 2) are spaced vertically along wall portion 26 to span the joint 28. Preferably, the wall clamps 36 are affixed to wall portion 26 through an adhesive or the like.

Figure 4:
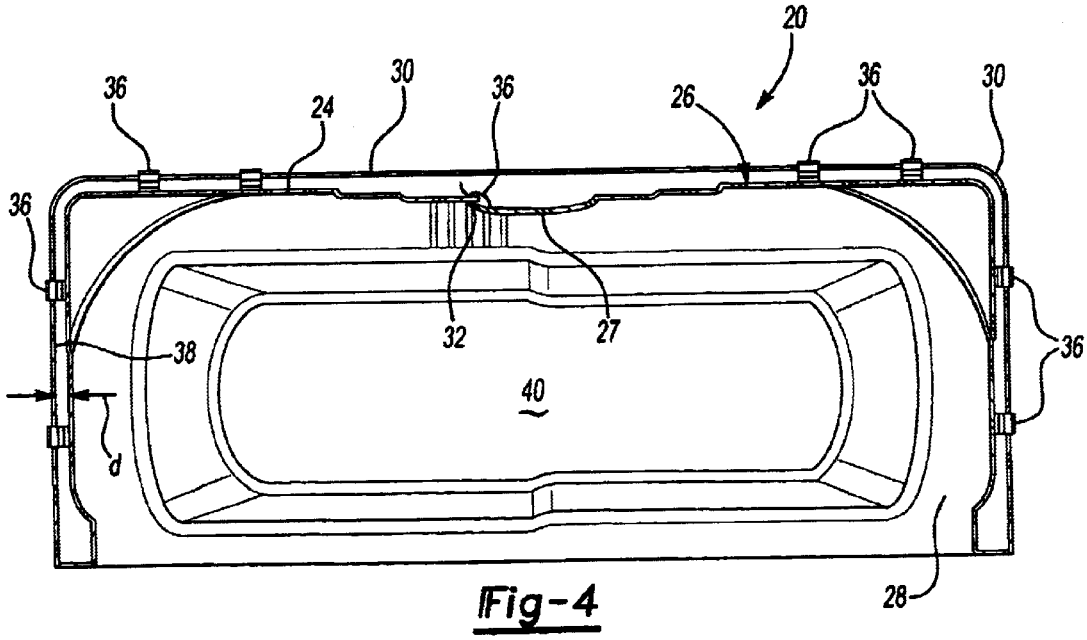
FIG. 4 is a general top view of the molded tub and surround.

A joint 38 is also defined between the wall portions 24 and 26 and the deck 28 of the tub potion 22. The joint 38 is defined where the wall portions 24 and 26 meet the deck 28 between the flange 30 and the tub bowl 40. A plurality of tub clamps 36 (also illustrated independently in FIG. 3) are spaced along the flange 30 to maintain a predefined distance d between the wall portions 24 and 26 and the flange 30 (FIG. 4). That is, clamps 36 are spaced about the inner perimeter of flange 30. Clamps 36 resist pressure exerted upon the lower portion of the wall portions 24 and 26 such as, for example only, should a person push upon the wall portions 24 and 26.

Figure 2:
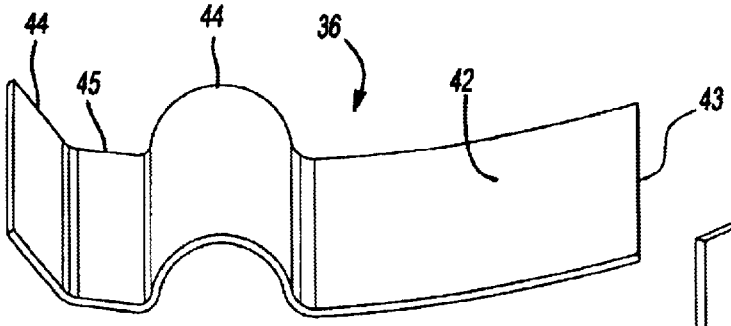
FIG. 2 is an expanded view of a wall clip.

Referring to FIG. 2, each wall clamp 36 is preferably manufactured of a spring steel. The clamp 36 includes a planar portion 42. A first end 43 of the planar portion 42 is affixed to the wall portion 26 through an adhesive or the like. An arcuate spring portion 44 extends from the planar portion 42 and an angled portion 44 extends from an opposite end 45 of the planar portion 42. The angled portion 44 assists in the engagement of wall portion 26 with wall portion 24 during installation while the arcuate spring portion 44 drives the wall portions 24, 26 together (FIG. 5).

Figure 3:
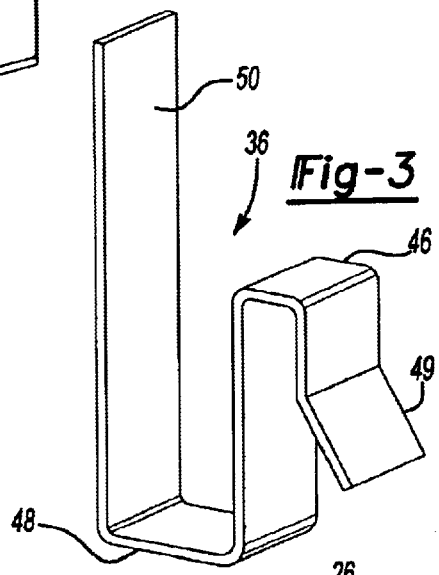
FIG. 3 is an expanded view of a tub clip.
Figure 6:
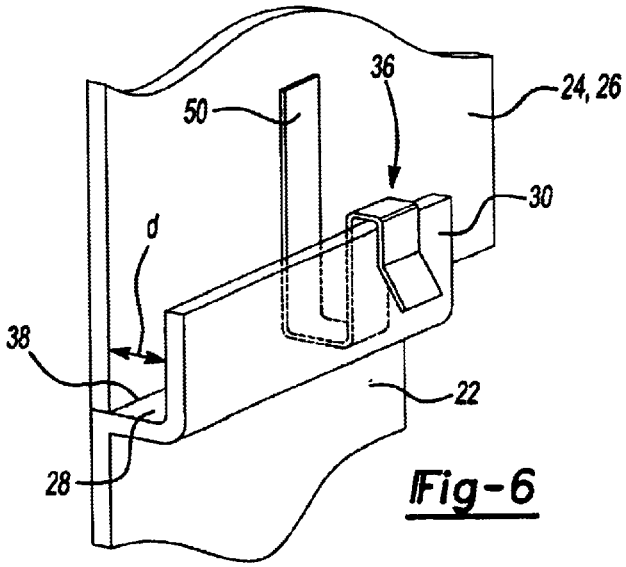
FIG. 6 is a partial view of the molded tub and surround illustrating the tub clip of FIG. 3 in an installed position.

Referring to FIG. 3, each tub clamp 36 includes a first substantially U-shaped portion 46 which engages the tub flange 30 (FIG. 6). An angled portion 49 assists in the installment of the tub clamp 36 upon the flange 30. A second substantially U-shaped portion 48 extends from the first substantially U-shaped portion 46 such that the tub clamp 36 generally defines an S-shape. The second substantially U-shaped portion 48 includes an extended planar arm 50. Preferably, the planar arm 50 is affixed to the lower edge of the wall portions 24, 26 such that the wall portions 24, 26 are simply clipped together and to the flange 30 (FIG. 6).

Figure 5:
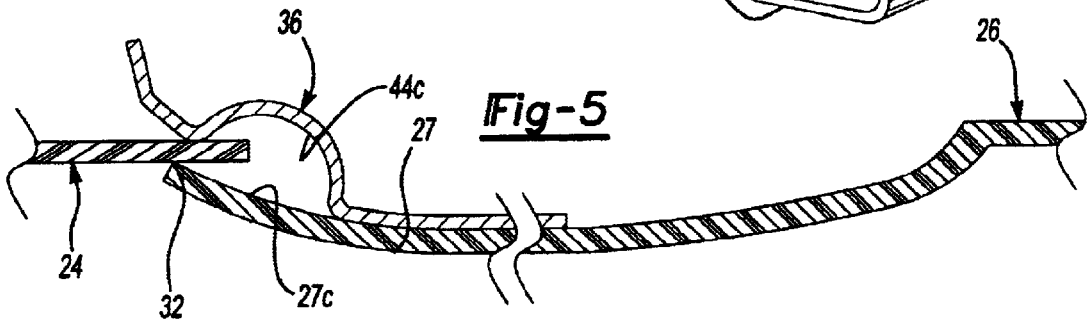
FIG. 5 is a partial view of the molded tub and surround illustrating the wall clip of FIG. 2 in an installed position.

Referring to FIG. 5, the wall portions 24 and 26 meet at the joint 32. The wall clamp 36 biases the partially arcuate portion 27 of wall portion 26 against the visible surface of wall portion 24. The term "visible" relates to the surface of the wall portions 24, 26 which face toward the interior of the tub portion 22 and does not mean that the engagement will necessarily be "visible" after assembly. The wall portion 24 is therefore sandwiched between the wall clamps 36 and the partially arcuate portion 27. That is a concave portion 44*c* of the arcuate spring portion 44 fares a concave portion 27*c* of the partially arcuate portion 27 of wall portion 76 The dimensions of the walls 24 and 26 are such that they are biased along their entire length into contact at joint 32.

Referring to FIG. 6, the tub clamps 36 are located upon flange 30. The planar arm 50 extends parallel to flange 30 to maintain the predefined distance d between the wall portions 24 and 26 and the flange 30. That is, tub clamps 36 are effectively a flange within the flange 30 to properly space the lower edge of wall portions 24, 26 inward from flange 30. The tub clamps resist pressure exerted upon the lower portion of the wall portions 24 and 26 and provide for additional reception of a caulking compound on both sides of joint 38.

The wall clamps 36 and tub clamps 36 assure an effective watertight molded tub and surround 20. However, it should be understood that a sealing compound may additionally be located on both sides of joints 32, 38 to further assure watertight integrity.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A tub surround comprising:

a first wall portion;

a second wall portion comprising a partially arcuate second wall portion, said partially arcuate second wall portion engageable with said first wall portion; and a wall clamp mounted to said partially arcuate portion such that said first wall portion is engaged between said wall clamp and said partially arcuate said second wall portion, said wall clamp comprising an arcuate spring portion, a concave portion of said arcuate spring portion facing a concave portion of said partially arcuate second wall portion.

2. The tub surround as recited in claim 1, further comprising a shower head aperture within said second wall portion.

3. The tub surround as recited in claim 1, wherein said wall clamp is affixed to said second wall portion.

4. The tub surround as recited in claim 1, wherein said wall clamp comprises a planar portion, said arcuate spring portion, and an angled portion.

5. The tub surround as recited in claim 4, wherein one segment of said planar portion affixed to said second wall portion, said angled portion extends from said planar portion opposite said one segment.

6. The tub surround as recited in claim 4, wherein said arcuate spring portion extends from said planar portion.

7. The tub surround as recited in claim 4, wherein said arcuate spring portion extends from said planar portion.

8. The tub surround as recited in claim 1, further comprising:

a tub surround having a flange; and a tub clamp mounted to said flange to space a lower edge of said first and second wall portions from said flange.

9. The tub surround as recited in claim 8, wherein said tub clamp comprises a substantially S-shaped member.

10. The tub surround as recited in claim 8, wherein said wall clamp is affixed to said second wall portion.

11. The tub surround as recited in claim 1, wherein said wall clamp comprises a planar portion mounted to said partially arcuate second wall portion.

12. The tub surround as recited in claim 1, wherein said partially arcuate second wall portion engageable with a visible surface of said first wall portion.

13. The tub surround as recited in claim 1, wherein said wall clamp extends past an end of said partially arcuate second wall portion.

14. A tub surround comprising:

a first wall portion;

a second wall portion comprising a partially arcuate second wall portion engageable with a face of said first wall portion;

a tub surround comprising a flange;

a wall clamp mounted to said partially arcuate second wall portion such that said first wall portion is engaged between said wall clip and said partially arcuate second wall portion, said wall clip comprising an arcuate spring portion, a concave portion of said arcuate spring portion facing a concave portion of said partially arcuate second wall portion; and a first tub clip extending from said first wall portion; and a second tub clamp extending from said second wall portion, said first and second tub clamps engageable with said flange to space a lower edge of said first and second wall portions from said flange.

15. The tub surround as recited in claim 14, wherein said lower edge of said first and second wall portions are located upon a deck of said tub surround between said flange and a bowl of said tub surround.

16. The tub surround as recited in claim 14, wherein each of said wall clamps comprises a planar portion, an arcuate spring portion, and an angled portion.

17. The tub surround as recited in claim 14, wherein each of said tub clamps comprise a substantially S-shaped member.

18. The tub surround as recited in claim 14, wherein said wall clamp comprises a planar portion mounted to said partially arcuate second wall portion.

19. The tub surround as recited in claim 14, wherein said partially arcuate second wall portion engageable with a visible surface of said first wall portion.

20. The tub surround as recited in claim 14, wherein said wall clamp extends past an end of said partially arcuate second wall portion.

* * * * *

UNITED STATES PATENT AND TRADEMARK OFFICE

CERTIFICATE OF CORRECTION

PATENT NO. : 6,691,339 B1
DATED : February 17, 2004
INVENTOR(S) : Thomas

It is certified that error appears in the above-identified patent and that said Letters Patent is hereby corrected as shown below:

Column 4,
Line 34, please change “clip” to read as -- clamp --

Signed and Sealed this

Twentieth Day of April, 2004

JON W. DUDAS
*Acting Director of the United States Patent and Trademark Office*